United States Patent [19]

Kaneda

[11] 4,353,011

[45] Oct. 5, 1982

[54] HOT CATHODE DISCHARGE LAMP LIGHTING DEVICE

[75] Inventor: Isao Kaneda, Otsu, Japan

[73] Assignee: New Nippon Electric Company, Ltd., Osaka, Japan

[21] Appl. No.: 211,158

[22] Filed: Nov. 28, 1980

[30] Foreign Application Priority Data

Nov. 27, 1979 [JP] Japan ..... 54-154092

[51] Int. Cl.[3] ..... H05B 41/16

[52] U.S. Cl. ..... 315/240; 315/101; 315/106; 315/244; 315/290; 315/DIG. 2

[58] Field of Search ..... 315/99, 101, 106, 207, 315/240, 244, 290, DIG. 2

[56] References Cited

U.S. PATENT DOCUMENTS 3,758,818 9/1973 Kaneda ..... 315/240 X 4,081,718 3/1978 Kaneda ..... 315/244

*Primary Examiner*—Eugene R. LaRoche

*Attorney, Agent, or Firm*—W. G. Fasse; D. F. Gould

[57] ABSTRACT

A parallel circuit of a capacitor and a switching element is connected to a hot cathode discharge lamp lighting device using a high frequency and high voltage generating means for permitting the flow of current into the filaments of the hot cathode type discharge lamp only at the lamp starting time. The switching element of the parallel circuit is a current controlled resistance element, such as a switching semiconductor, having a break-over voltage $V_{BO}$ lower than the capacitor terminal voltage during the initial ignition period and higher than the capacitor terminal voltage during the reignition or operation period, whereby the filament current to the discharge lamp may be used for preheating of the filament in the initial ignition period. The filament current may be stopped or reduced by turning off of the switching element by raising the terminal voltage of the capacitor in the reignition period during normal operation. Thus, the lumen-per-watt efficacy of the lighting device is improved since the filament current is substantially eliminated during the lamp operation. After the initial ignition period it is preferred to use the capacitor of the parallel circuit as an intermittent commutation capacitor in the high frequency and high voltage generating oscillation circuit having an oscillation capacitor, a nonlinear inductor and a thyristor.

12 Claims, 11 Drawing Figures

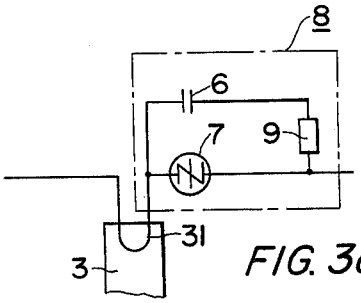
FIG. 3a
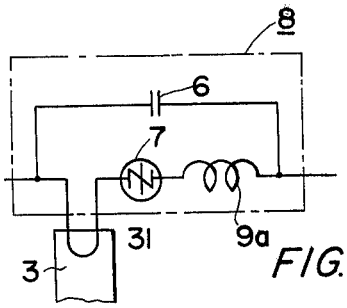
FIG. 3b
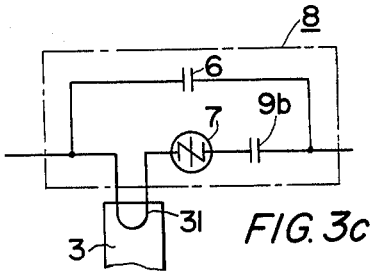
FIG. 3c
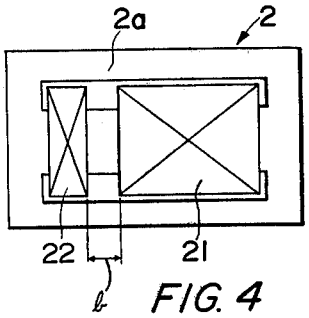
FIG. 4
FIG. 5
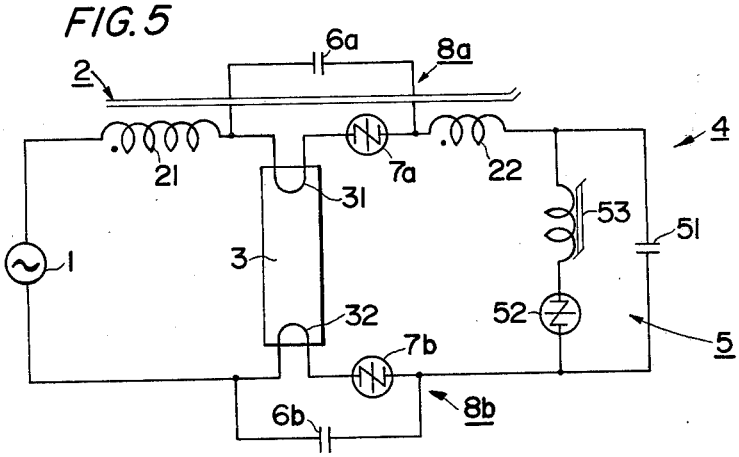

HOT CATHODE DISCHARGE LAMP LIGHTING DEVICE

BACKGROUND OF THE INVENTION

This invention relates to a discharge lamp lighting device employing a booster circuit for starting and/or reigniting discharge lamp means. More particularly the invention relates to filament heating circuit arrangements used in hot cathode discharge lamp lighting device suitable for home use.

In recent years various types of discharge lamp lighting devices have been developed for using energy in an optimum manner to save energy. In such devices an oscillation circuit or booster is used for starting and/or reigniting a discharge lamp, as disclosed in U.S. Pat. Nos. 3,665,243; 3,753,073; 3,758,818; 3,866,088; 3,942,069; 4,081,718; 4,145,638 for a starter, and U.S. Pat. No. 4,079,292. Reference is also made to my U.S. Pat. No. 4,306,177 granted on Dec. 15, 1981; and U.S. Pat. No. 4,238,708, granted on Dec. 9, 1980 referring to discharge lamp lighting devices.

The following explanations shall facilitate the understanding of the functions and problems involved in the initial igniting and subsequent reigniting involved in the so called "every half cycle ignited system" as disclosed in U.S. Pat. No. 4,079,292. FIG. 1 shows a conventional lighting device for discharge lamps comprising an a.c. power source 1, a current limiting ballast choke 2 with primary and secondary windings 21,22, a discharge lamp 3 with filaments 31,32 connected in series with the source 1 through the primary winding 21 of the choke 2, and a high frequency and high voltage generating circuit 4 for generating a high frequency and high voltage output. The high voltage circuit 4 is connected to the lamp 3 at the side opposite the source through the secondary windng 22, and comprises an oscillation circuit 5 including an oscillation capacitor 51 and a series circuit of a thyristor 52 and a non-linear inductor 53, and an intermittent oscillation capacitor 6 connected in series with the oscillation circuit 5. Besides, a circuit using gated thyristors such as a triac, or a circuit of the inverter type may be substituted for the high voltage circuit 4 as long as the circuit generates a high frequency oscillation output intermittently.

In the operation, by switching on the power source 1, the source voltage is supplied to the discharge lamp 3 through the primary winding 21 of the ballast choke 2, and supplied to the high voltage circuit 4 through the primary winding 21, the filaments 31, 32 and the secondary winding 22. As for the high voltage circuit 4, the source voltage is supplied to the thyristor 52 through the intermittent oscillation capacitor 6, so as to break-over the thyristor 52. Thus, the oscillation circuit 5 begins its oscillating operation to generate a high frequency oscillation output. The oscillating operation will continue if the intermittent oscillation capacitor 6 is removed. However, since the capacitor 6 is gradually charged up due to the oscillating operation of the oscillation circuit 5 and the terminal voltage of the capacitor 6 cancels the source voltage, the thyristor 52 becomes non-conductive after a definite time, whereby the high voltage circuit 4 generates the oscillation intermittently with an initial phase of a steeply increasing source voltage in every half cycle. Hence, the high voltage circuit 4 generates an intermittent oscillation output in every fixed phase or rather in every half cycle of the a.c. source voltage.

The oscillation output voltage is divided by the primary winding 21 and secondary winding 22 of the ballast choke 2, and terminal voltage of the primary winding 21 with superposing the source voltage is supplied to the discharge lamp 3. At the same time, the input current of the high tension circuit 4 flows through a closed circuit comprising the elements 1-21-31-22-4-32-1 so as to preheat the filaments 31, 32. After the filaments 31, 32 are sufficiently preheated, the discharge lamp 3 is triggered by the oscillation output of the high voltage circuit 4 and starts its initial ignition. When the lamp is operated, an appearing period of input current becomes shorter than that of the starting time for preheating due to the impedance change of the ballast choke 2 caused by the flowing lamp current. To reduce the preheating current during normal lamp operation the oscillation operation of the circuit 4 and the preheating operation of the filaments 31, 32 are stopped. Thus, the discharge lamp 3 maintains its lit state by the reignition due to the output of the high tension circuit 4 at every half cycle of the power source 1. In such condition, the lamp voltage shows a rectangular waveform with a suspended period corresponded to the period of the intermittent oscillation, the effective value of which becomes somewhat lower compared with that of a conventional discharge lamp lighting system. Since the intermittent input current of the high voltage circuit 4 flows through the ballast choke 2, the waveform of the lamp voltage is somewhat elevated by the effect of the intermittent input current. The appearing phase of the intermittent input current is kept constant regardless of fluctuation of the source voltage, so that the initial phase of the lamp current is maintained to have a constant phase regardless of the fluctuation of the source voltage. Further the intermittent input current has a negative coefficient characteristic to decrease its value due to an encroachment of a remaining portion of the lamp current waveform upon the occurring period of the next half cycle input current if the lamp current increases due to the increase of the source voltage. For this reason, the fluctuation of the lamp current in the "every half cycle ignited lighting system" is favorably maintained in spite of the reduction of the stabilizing inpedance. Calculations of the accumulated energy and necessary inductance of the ballast choke 2, shown that the energy is about 25% and the inductance is about 20% compared to the respective values of a conventional glow start system. Therefore, in the "every half cycle ignited lighting system" the ballast choke 2 may be minimized in accordance with the above ratio. Further, the minimizing ratio becomes more remarkable if it is compared to that of the rapid start system using a step up transformer. Still further, since the phase difference between the source voltage and lamp current is smaller than that of other conventional lighting systems, it becomes possible to omit a power-factor improving capacitor or to use only a capacitor having an extremely small capacitance.

As described above, the "every half cycle ignited lighting system" has remarkable advantages of saving energy and materials. It also makes it possible to use the secondary winding 22 as the ballast choke 2, because of the effect of the improved fluctuation rate due to the input current in spite of the reduction in the number of windings turns of the primary winding 21 of the ballast choke 2. That is, because the impedance of the oscillation circuit 5 in its oscillating operation is small enough to be neglected and the input inpedance of the oscillation circuit 5 in oscillating operation is substantially composed of the capacitive impedance of the ballast choke 2 resulting in a small capacitive impedance of the input part of the oscillation circuit 5, the secondary winding 22 is provided in the ballast choke 2 and is connected across the filaments 31, 32 of the discharge lamp 3 at the side opposite the source whereby it is possible to bring the oscillation phase of the oscillation circuit 5 and the reignition phase of the discharge lamp 3 close to the source voltage phase. Moreover, because the lamp current of the discharge lamp 3 flows through only the primary winding 21 of the ballast choke 2, the ballast choke may be remarkably minimized or reduced in size in comparison with a case wherein the primary winding 21 of the ballast choke 2 is subject to the inductance value of the secondary winding 22.

In the "every half cycle ignited lighting systems" as described above the fluctuation rate is improved by the secondary winding 22 of the ballast choke 2, and the size of the ballast choke 2 can be minimized. However, the filament preheating current tends to be insufficient by reason of the intermittent current for heating the filaments 31, 32 of the discharge lamp 3. To increase the heating current, one may consider arranging the oscillation capacitor 51 in the source side of the circuit between the filaments 31 and 32, but this is difficult for the above arrangement, because the oscillation current of the high voltage circuit 4 is blocked by the secondary winding 22 of the ballast choke 2.

Therefore, a more efficient lighting device supplying a sufficient preheating current for the filaments is required particularly for the home use type of lighting device which requires a larger heating current than that of the commercial use type.

OBJECTS OF THE INVENTION

In view of the foregoing, it is the aim of the invention to achieve the following objects singly or in combination:

to provide a discharge lamp lighting device employing a high frequency and high voltage generating means for starting or operating of hot cathode discharge lamps wherein the preheating current is increased by the use of a parallel connected circuit of a capacitor and a switching element so as to improve the lamp characteristics;

to provide a discharge lamp lighting device for an electronic starting system or for an "every half cycle ignited operating system", wherein high frequency and high voltage generating means are used for heating the filaments of a hot cathode discharge lamp, and a parallel connected or closed circuit including a capacitor, a switching element and at least one filament of the lamp is formed for providing a sufficient heating current to the filament and attaining a high efficiency of the lighting device;

to provide an improved lighting device for a discharge lamp having filaments to be preheated at the starting period, wherein a parallel connected or closed circuit having a capacitor for intermittent oscillation and a switching element which becomes conductive at the starting or initial igniting period due to the terminal voltage of the capacitor and which becomes non-conductive after the lamp has become lit due to decreasing the terminal voltage of the capacitor; and to provide a lighting device for discharge lamp means including high frequency and high voltage output generating means for the initial ignition and/or reignition in a circuit having an oscillation capacitor, a nonlinear inductor as well as a thyristor, and controlling means for the filament current at the starting period of the discharge lamp means, wherein the controlling means are formed by a closed circuit of a capacitor and a switching semiconductor in parallel connection, wherein the discharge current of the capacitor is utilized during the preheating time of the discharge lamp to improve the efficiency of the lighting device.

SUMMARY OF THE INVENTION

In accordance with the invention there is provided a discharge lamp lighting device comprising high voltage generating means for the initial ignition and/or reignition of a hot cathode discharge lamp wherein the heating current for the filaments of the lamp is increased by using a parallel connected or closed circuit including a capacitor and a switching element or current regulated type resistance element at the starting period in order to improve the lumen per watt efficiency of the lighting device. According to one aspect of the present invention, the parallel connected or closed circuit for improving the filament preheating of a discharge lamp or lamps in the lighting device comprises a capacitor, a switching element such as a switching semiconductor in parallel connection with the capacitor, and current regulating means such as an inductance or capacitance element and/or lamp filament connected in the closed circuit wherein the switching element has a break-over voltage lower than the terminal voltage across the capacitor in during the starting period and higher than the terminal voltage across the capacitor in the operating period of the discharge lamp in order to increase the preheating current. In other words, the parallel connected circuit makes a short-circuit or intermittently shortened circuit as an input capacitance circuit during starting time. When the filaments are in the sufficiently hot cathode state to start the discharge lamp operation, the given small capacitance of the closed circuit is maintained due to the non-conductive state of the switching element so as to assure the high efficient operation of the lighting device.

According to another aspect of the invention, the high frequency and high voltage generating means for the lighting device comprise an oscillation circuit formed by an oscillation capacitor, a thyristor and a non-linear inductor, and an intermittent capacitor connected in series to the oscillation circuit, in which the intermittently operating circuit part is composed of a parallel connected or closed circuit together with a switching element to improve the preheating operation of a hot cathode discharge lamp. It is desirable to connect one of the lamp filaments in the parallel connected circuit so as to supply a sufficient preheating current to the filament due to the charging of the capacitor at the starting period of the discharge lamp.

BRIEF FIGURE DESCRIPTION

In order that the invention may be clearly understood, it will now be described, by way of example, with reference to the accompanying drawings, wherein.

Figure 2:
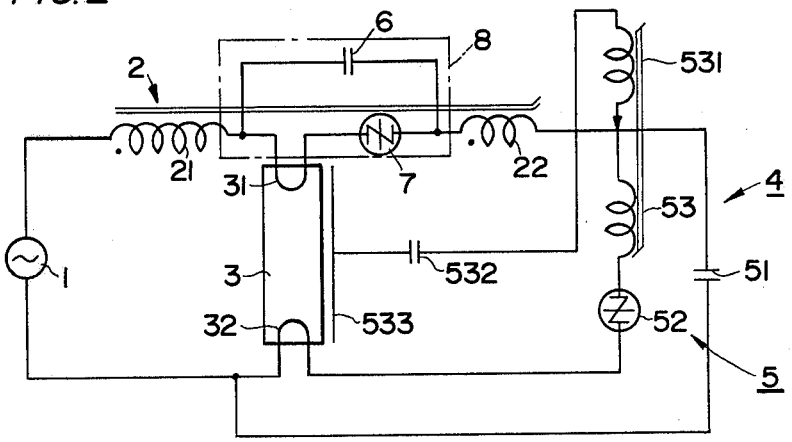
FIG. 2 is a circuit of an embodiment according to the present invention.
Figure 6:
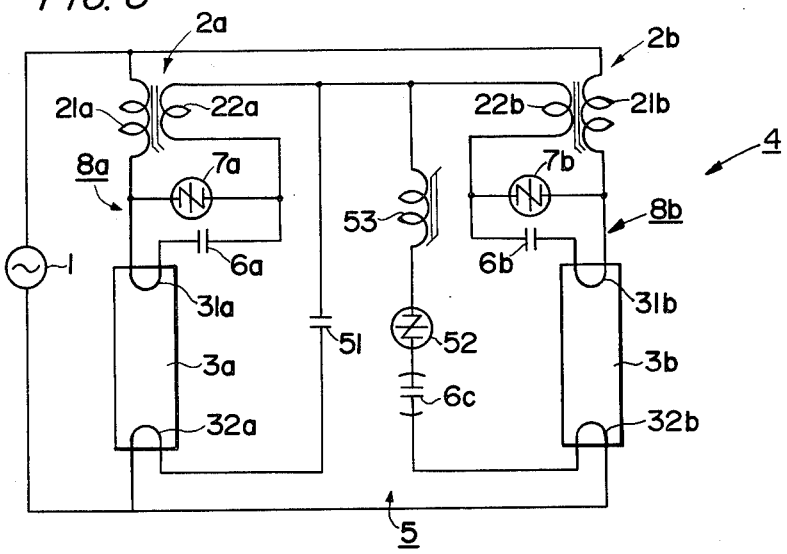
Figure 7:
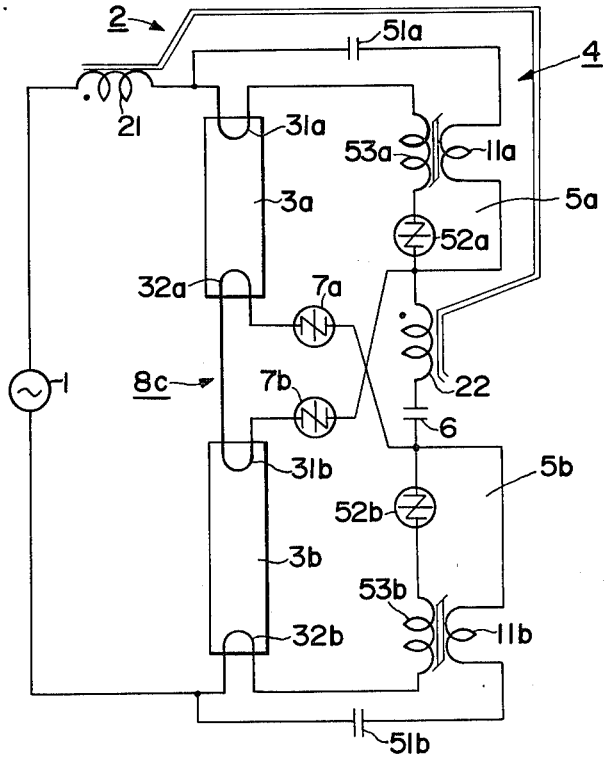
Figure 8:
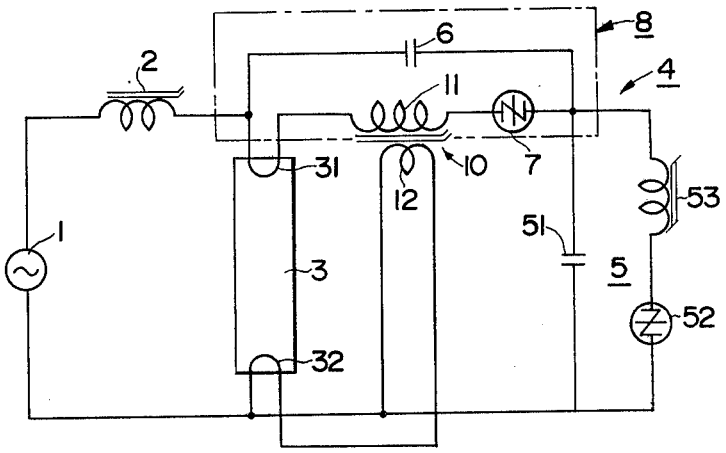
Figure 9:
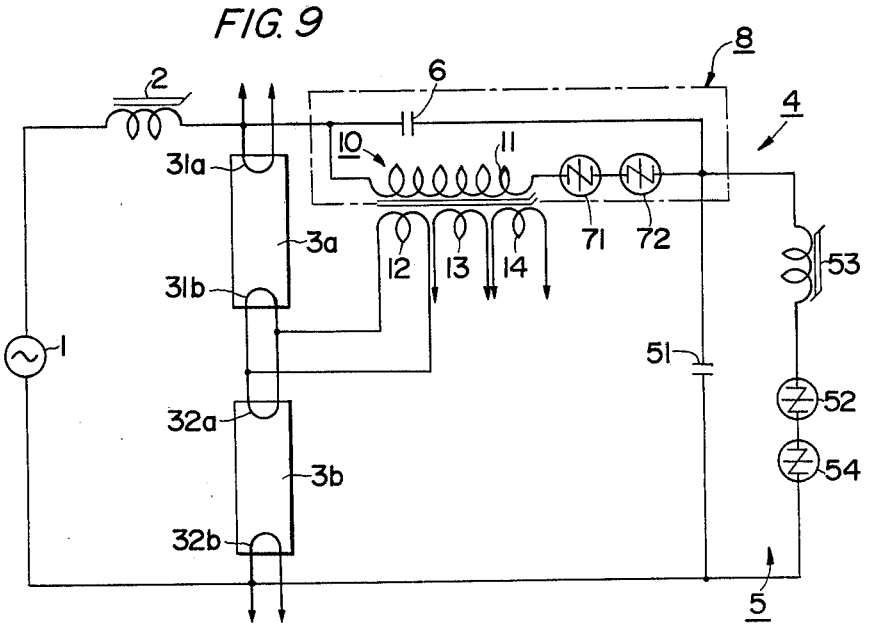

FIGS. 3(*a*) to (*c*) are circuits each showing a different type of a parallel connected circuit applicable to the circuit of FIG. 2;

FIG. 4 is an arrangement of a ballast choke used in FIG. 2;

FIG. 5 is a modification of the circuit of FIG. 2;

FIG. 6 is a further modification of the circuit of FIG. 2 using two lamps;

FIG. 7 is a modification of the circuit of FIG. 6;

FIG. 8 is a circuit of another embodiment according to the present invention and;

FIG. 9 is a modification using two lamps of the circuit of FIG. 8.

DETAILED DESCRIPTION OF PREFERRED EXAMPLE EMBODIMENTS AND OF THE BEST MODE OF THE INVENTION:

FIG. 2 is an electric circuit of a discharge lamp lighting device of the "every half cycle ignited system" type for an embodiment of the present invention in which a hot cathode discharge lamp 3 is operated by an intermittent booster or amplifier circuit 4 as means for generating high frequency and high voltage output. An a.c. source 1 is connected to the discharge lamp 3 in series through a primary winding 21 of a ballast choke 2. A series connection of a first thyristor 7 as a switching element, a secondary winding 22 of the ballast choke 2, non-linear inductor 53 and a second thyristor 52 is connected across the discharge lamp 3 at the side opposite the source. In other words, between filaments 31, 32 of the discharge lamps 3, the booster circuit 4 is connected, which comprises in combination of an oscillation circuit 5 having an oscillation capacitor 51 and a series circuit of the thyristor 52 and non-linear inductor 53, and a parallel connected circuit 8.

The oscillation capacitor 51 is connected in parallel with the series circuit of the inductor 53, thyristor 52 and filament 32 so as to constitute the oscillation circuit 5. In addition a capacitor 6 which acts as an intermittent oscillation capacitor is connected in parallel with a series circuit of the filament 31 and thyristor 7 to form the parallel connected or closed circuit 8. A further intermittent capacitor may be connected in series with the thyristor 52 for using the large capacitance capacitor as the first capacitor 6. Further, a secondary winding 531 may be provided with the inductor 53, which is connected in series with a current limiting capacitor 532 and a conductor 533 of the lighting device.

Figure 1:
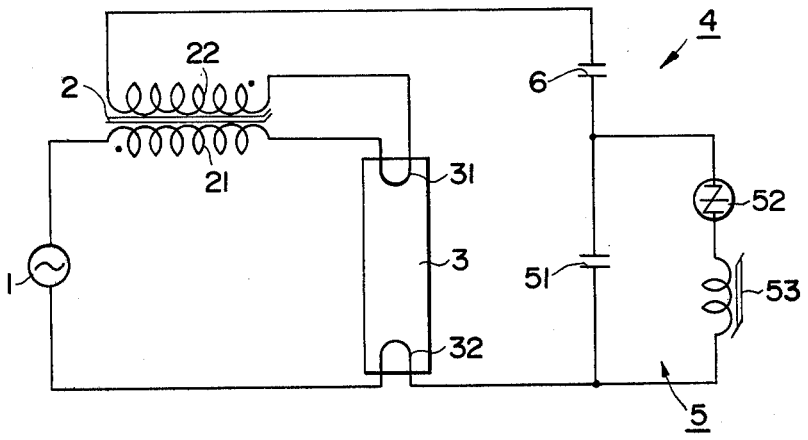
FIG. 1 (PRIOR ART)
FIG. 1 is a circuit of a conventional discharge lamp lighting device of the "each half cycle ignited system" type.

In operation, by switching on the power source 1, current flows through a path comprising the elements 1-21-6-22-5-1 to charge the oscillation capacitor 51. When a terminal voltage of the oscillation capacitor 51 exceeds the break-over voltage of the second thyristor 52, the oscillation circuit 5 begins to oscillate. The intermittent booster or amplifier circuit 4 begins an intermittent oscillating operation in the same menner as described in the circuit of FIG. 1, due to the series connection of the intermittent oscillation capacitor 6 connected between the primary winding 21 and the secondary winding 22 of the ballast choke 2.

The oscillation output is supplied to the discharge lamp 3 whereby it is superposed on the source voltage. At the same time, the oscillation current flows through a path comprising the elements 51-53-52-32-51 so as to preheat the filament 32. When the charged voltage of the intermittent oscillation capacitor 6 exceeds the break-over voltage of the first thyristor 7 in the parallel connected circuit 8, the first thyristor 7 becomes conductive and a pulse discharge current flows from the intermittent oscillation capacitor 6, whereby the filament 31 is preheated by such pulse discharge current. The thyristor 7 keeps its conductive state while the filaments 31, 32 are preheated continuously. When the filament 31 is not coupled within the circuit 8, the discharging pulse current of the intermittent oscillation capacitor 6 will be extremely large such as several hundred amperes, but such current within the circuit 8 is suppressed by the existing resistance of the filament 31 to a valve of about ten amperes, whereby undesirable destruction of the first thyristor 7 is prevented.

While the secondary winding 531 of the non-linear inductor 53 steps up the oscillation output of the oscillation circuit 5 for applying a boosted output voltage to the conductor 533 placed closely to the discharge lamp 3, through the current limitting capacitor 532, the oscillating output may be supplied to the discharge lamp 3 advantageously without blocking high frequency components by the secondary winding 22 of the ballast choke 2. It is noted that the lighting device itself may be used as the conductor. Further, since it is necessary to use for the first thyristor 7 a thyristor having a high voltage rating to withstand high terminal voltage of the capacitor 6 for intermittent oscillation, a further intermittent oscillation capacitor may be connected between the second thyristor 52 and the filament 32 at the side opposite the source. Such further intermittent oscillation capacitor may share a part of the output voltage, whereby the thyristor 7 may have a lower voltage rating.

FIGS. 3(*a*) to 3(*c*) show different types of parallel connected circuits used in the present invention. In FIG. 3(*a*), the parallel connected circuit 8 of a capacitor 6 and of the first thyristor 7 includes a current regulating or limiting element 9 such as an inductor whereby the discharging current of the capacitor 6 may be limited. FIG. 3(*b*) is another type of the circuit 8 in which an inductor **9*a* is used in a series connection with the first thyristor 7 to restrict the pulse current. In this case the filament 31 is also inserted within the circuit 8**. In FIG. 3(*c*) a second capacitor **9*b* is substituted for the inductor 9*a*** in FIG. 3(*b*) to restrict the pulse current similarly. Also, diode or resistance elements may be used as current regulating means. Further, the circuit may be modified so that the thyristor 7 is connected in parallel with a series circuit of the filament 31 and capacitor 6.

FIG. 4 is a plan view showing a construction of the current limitting ballast choke 2, in which the primary winding 21 and secondary winding 22 are wound to be spaced by a given interval or gap "b" on a core formed as a single body magnetic path **2*a*. In this construction induction of the oscillation current flowing through the secondary winding 22 of the primary winding 21 can be prevented whereby leakage of the high frequency component to the power source 1 in FIG. 2** may be advantageously prevented.

FIG. 5 is an electric circuit diagram of a modification of FIG. 2, in which a second parallel connected circuit **8*b* similar to the closed circuit 8, is added for the filament 32 at the other side of the discharge lamp 3. The second parallel connected circuit 8*b* includes a series circuit of the filament 32, a thyristor 7*b*, and a capacitor 8*b* for intermittent oscillation. The first parallel connected circuit 8*a*** includes a series circuit of the filament 31, a thyristor 7a, and a capacitor 6a for intermittent oscillation, whereby each of the filaments 31, 32 may be preheated by the pulse currents from each of intermittent oscillation capacitors 6a, 6b. Thus, each of the thyristors 7a, 7b may have a lower rated withstanding voltage.

FIG. 6 is an electric circuit diagram of a discharge lamp lighting device of another embodiment of the present invention, in which two discharge lamps 3a, 3b are operated in a parallel connection. A first parallel connected circuit 8a is formed by the filament 31a of the discharge lamp 3a, the intermittent oscillation capacitor 6a and the thyristor 7a. A second parallel connected circuit 8b is formed by the filament 31b, intermittent oscillation capacitor 6b and the thyristor 7b. Each of the filaments 32a, 32b at opposite sides of the discharge lamp 3a, 3b is connected in series within the intermittent booster or amplifier circuit 4. In the case of the parallel connection of two discharge lamps 3a, 3b, the filament 31a is preheated by the pulse current of the intermittent oscillation capacitor 6a of the circuit 8a, and the filament 31b is similarly preheated by the pulse current of the intermittent oscillation capacitor 6b of the circuit 8b. Further, the filaments 32a, 32b may also be preheated by the oscillation current of the intermittent booster circuit 4. Still further, the use of a thyristor of a lower voltage rating for each of the thyristors 7a, 7b may be possible by making the capacitances of each intermittent oscillation capacitor 6a, 6b in each of the circuits 8a, 8b comparatively large, and by connecting a third intermittent oscillation capacitor 6c in series between the thyristor 52 and the filament 32b at the side opposite the source.

FIG. 7 is a modification wherein the discharge lamps 3a, 3b are connected in series with each others so as to supply the discharge lamps 3a, 3b with an oscillation voltage of the booster or amplifier circuit 4 formed by a series connection of the oscillation circuits 5a, 5b. That is, the oscillation circuits 5a, 5b are connected in series with each others through the secondary winding 22 of the ballast choke 2 and the intermittent oscillation capacitor 51a of the circuit 5a is connected in series with a bias winding 11a to provide a positive bias of a non-linear inductor 53a. An oscillation capacitor 51b of the circuit 5b is connected similarly in series with a bias winding 11b to provide a positive bias of a non-linear inductor 53b. A parallel connected circuit 8c is formed by a series connection of the thyristors 7a, 7b and the filaments 32a, 31b including the second winding 22 of the ballast choke 2 and the intermittent oscillation capacitor 6. In the operation, by switching on an a.c. power source 1, the booster circuit 4 begins the intermittent oscillating operation in the same manner as described above. Thus, the filament 31a of the discharge lamp 3a is preheated by the oscillation current of the oscillation circuit 5a, and the filament 32b of the discharge lamp 3b is also preheated by the oscillation current of the oscillation circuit 5b. Besides, the thyristors 7a, 7b become conductive by the terminal voltage of the charged intermittent oscillation capacitor 6, whereby the filament 31b of the discharge lamp 3b is respectively preheated by the pulse current of the intermittent oscillation capacitor 6. Further, the discharge lamps 3a, 3b are supplied with the sum voltage of the oscillation voltage of the circuits 5a, 5b and source voltage, accordingly, the discharge lamps 3a, 3b are lighted through the initial ignition.

FIG. 8 is an electric circuit diagram of a further embodiment of the present invention, which is similar to the circuit of FIG. 2, but the parallel connected circuit 8 and the ballast choke 2 are different in FIG. 8. That is, the parallel connected circuit 8 is formed by a capacitor 6, a thyristor 7, and an inductive element 10 connected in series with the thyristor 7. The inductive element 10 has a primary winding 11 within the circuit 8 and a secondary winding 12 connected across the filament 32 of the discharge lamp 3. The operation of the circuit is similar to that of the circuit in FIG. 2, except that the choke 2 does not have a secondary winding. The filament 32 of the discharge lamp is preheated by the pulse current in the parallel-connected circuit 8 through the secondary winding of the inductive element 10 whereby an effective preheating can be achieved without any electrode power loss.

FIG. 9 is an electric circuit diagram of a discharge lamp lighting device of a still further embodiment of the present invention, in which two discharge lamps 3a, 3b are operated in series connection. A parallel connected circuit 8 is formed by a capacitor 6 for intermittent oscillation, series connected thyristors 71 and 72, and inductance means 10 having a primary winding 11 and a plurality of secondary windings 12, 13 and 14. The primary winding 11 of the inductance means 10 is connected in series with the thyristors 71, 72 to function as the current regulating means in the circuit 8. The secondary windings 12, 13 and 14 are connected respectively across filaments 31a, 32a and 31b, 32b of the discharge lamps 3a and 3b to supply the pulse current of the intermittent oscillation capacitor 6 in the circuit 8. The filament 31a is coupled to one of the secondary windings 13, 14, filaments 31b and 32b are coupled to the secondary winding 12, and the filament 32b is coupled to another of secondary windings 13, 14 so as to preheat the filaments 31a, 31b, 32a and 32b during the initial ignition period for starting the discharge lamps 3a, 3b. The series connection of the thyristors 71, 72 is effective to use lower voltage rated thyristor elements by dividing the terminal voltage of the capacitor 6.

Although, in the above-mentioned embodiments, the present invention is applied to a discharge lamp lighting device of the "every half cycle ignited lighting system" or so called "Power Cycle" systems, it may also be employed in electronic starting devices and in hybrid ballast operating systems of the so called "Instarter type". A "Power Cycle" system is shown in U.S. Pat. No. 4,079,292 and is characterized by the use of an intermittent oscillator to supply the reingition energy after each lamp current phase in order to decrease the voltage across the choke coil. By this system, not only a ballast minimization, but also a high efficiency, a high power factor, and a high reliability are achieved as well as a long lamp life. The audio noise are acceptably low and RFI noise and the distortion ratio of the input current is also low. Additionally such systems are comparatively inexpensive.

An "Instarter" system is shown in U.S. Pat. No. 4,081,718 and has a single winding choke coil in a conventional operating circuit, a semiconducterized starter, and a power factor improvement capacitor within the same casing, in which the starter utilizes the same kind of oscillator as in a "Power Cycle" system. The rising of the oscillation is delayed at starting to improve the length of the lamp life. In this case, the oscillator ceases its operation completely, after the lamp starts. The merits of the "Instarter" system are seen in that the weight and efficiency of the device are the same as those of a conventional switchstart system in spite of achieving a rapid starting and a high power factor operation.

As described above by means of the parallel connected circuit of the capacitor and switching element for preheating the filaments, a larger filament preheating current may be obtained than by conventional high frequency and high voltage generating means for providing the filament preheating current.

Although the invention has been described with reference to specific example embodiment it will be appreciated that it is intended to cover all modifications and equivalents within the scope of the appended claims.

What is claimed is:

1. A discharge lamp lighting device, comprising hot cathode type discharge lamp means having filaments connected across an a.c. power source through current limiting means, high frequency, high voltage generating means connected in parallel with said discharge lamp means to apply a high frequency and high voltage output thereto at least at the time of initial ignition, and a parallel circuit including a capacitor and a switching element connected to one of said filaments, said switching element comprising a current controlled resistance type switching semiconductor having a break-over voltage lower than the terminal voltage of said capacitor at the initial ignition period and higher than said capacitor terminal voltage during the lamp operating reignition period, whereby the current flowing through said one filament is reduced during the lit operation of the lamp.

2. The discharge lamp lighting device of claim 1, wherein said capacitor of said parallel circuit provides an intermittent oscillation, and wherein said high frequency, high voltage generating means comprise an oscillation circuit including a series circuit of a thyristor and a non-linear inductor, and an oscillation capacitor connected in parallel with said series circuit.

3. The discharge lamp lighting device of claim 2, wherein one of the filaments of said discharge lamp means is connected in said parallel circuit and another of said filaments is connected in said oscillation circuit for increasing the preheating current.

4. The discharge lamp lighting device of claim 1, wherein said high frequency, high voltage generating means comprises in combination an oscillation circuit and an intermittent oscillation capacitor connected in series with said oscillation circuit for generating an intermittent high frequency and high voltage output at a given phase in every half cycle of said a.c. power source for sustaining a reignition operation of said discharge lamp means.

5. The discharge lamp lighting device of claim 4 wherein said capacitor of said parallel circuit is the same as said intermittent oscillation capacitor.

6. The discharge lamp lighting device of claim 1, wherein said parallel circuit further includes current regulating means for the discharging current of said capacitor.

7. The discharge lamp lighting device of claim 6, wherein said current regulating means is one of said filaments of said hot cathode discharge lamp means.

8. The discharge lamp lighting device of claim 6, wherein said current regulating means is an impedance element such as a capacitor or inductor added to said parallel circuit.

9. The discharge lamp lighting device of claim 1, wherein said parallel circuit further includes an inductance means provided with a secondary winding, and said secondary winding is connected across one of said filaments of said hot cathode discharge lamp means.

10. The discharge lamp lighting device of claim 1, wherein said filaments of said hot cathode discharge lamp means comprise a pair of filaments one filament of which is connected in said parallel circuit, and wherein said parallel circuit comprises an inductor having a secondary winding connected in parallel with the other filament of said pair of filaments of said hot cathode discharge lamp means.

11. The discharge lamp lighting device of claim 1, wherein said hot cathode discharge lamp means comprise a plurality of hot cathode discharge lamps, said parallel circuit further including inductive means having a primary winding and a secondary winding, said primary winding being connected in series with said switching element of said parallel circuit, and wherein said secondary winding is connected across one of said filaments of said hot cathode discharge lamps.

12. The discharge lamp lighting device of claim 11, wherein each of said hot cathode discharge lamps has filaments, and said inductive means has a plurality of secondary windings, each of said secondary windings being connected across one or more filaments of said hot cathode discharge lamps for supplying preheating current due to the discharging current of said capacitor in said parallel circuit.

* * * * *